US007353807B2

(12) United States Patent
Paluszewski

(10) Patent No.: US 7,353,807 B2
(45) Date of Patent: Apr. 8, 2008

(54) JET PUMP ASSEMBLY OF A FUEL SYSTEM FOR A COMBUSTION ENGINE

(75) Inventor: Paul J. Paluszewski, Meriden, CT (US)

(73) Assignee: TI Group Automotive Systems, L.L.C., Warren, MI (US)

( * ) Notice: Subject to any disclaimer, the term of this patent is extended or adjusted under 35 U.S.C. 154(b) by 68 days.

(21) Appl. No.: 11/390,329

(22) Filed: Mar. 27, 2006

(65) Prior Publication Data

US 2006/0231079 A1 Oct. 19, 2006

Related U.S. Application Data

(60) Provisional application No. 60/672,788, filed on Apr. 19, 2005.

(51) Int. Cl.
*F02M 37/04* (2006.01)
*F02B 77/08* (2006.01)

(52) U.S. Cl. ..... 123/509; 123/198 D

(58) Field of Classification Search ..... 123/509, 123/510, 511, 198 D

See application file for complete search history.

(56) References Cited

U.S. PATENT DOCUMENTS 4,503,885 A * 3/1985 Hall ..... 137/574
4,860,714 A 8/1989 Bucci
5,289,810 A * 3/1994 Bauer et al. ..... 123/510
5,692,479 A * 12/1997 Ford et al. ..... 123/514
5,791,317 A * 8/1998 Eck ..... 123/510
6,123,511 A * 9/2000 Sertier ..... 417/87
6,155,238 A 12/2000 Briggs et al.
6,213,726 B1 4/2001 Tuckey
6,343,589 B1 2/2002 Talaski et al.

* cited by examiner

*Primary Examiner*—Thomas Moulis
(74) *Attorney, Agent, or Firm*—Reising, Ethington, Barnes, Kisselle, P.C.

(57) ABSTRACT

A fuel system has a jet pump assembly that fills a fuel reservoir for providing a reliable source of fuel to an electric motor fuel pump located in a fuel tank for a combustion engine. The electric fuel pump preferably delivers fuel at a controlled pressure to a series of fuel injectors of the engine. A small portion of the fuel exiting the electric fuel pump is diverted to the jet pump assembly that aspirates fuel from the fuel tank and into the reservoir. A biased normally closed pressure responsive valve prevents fuel flow to the jet pump when the electric fuel pump is running under impaired conditions, thus providing all the fuel to the combustion engine typically during cold engine start conditions.

13 Claims, 4 Drawing Sheets

JET PUMP ASSEMBLY OF A FUEL SYSTEM FOR A COMBUSTION ENGINE

REFERENCE TO RELATED APPLICATION

Applicant claims the benefit of U.S. provisional application, Ser. No. 60/672,788, filed Apr. 19, 2005.

FIELD OF THE INVENTION

This invention relates generally to a liquid fuel system of a combustion engine of an automotive vehicle and more particularly to a jet pump assembly of the fuel system for maintaining fuel level in a reservoir disposed in a fuel tank.

BACKGROUND OF THE INVENTION

Electric motor fuel pumps are commonly used to supply the fuel demand for engines in a wide variety of applications. The electric fuel pump is known to be integrated into an in-tank fuel pump module typically having a filter at the pump inlet, a check valve at the pump outlet and a pressure regulator, downstream of the outlet check valve, for controlling fuel pressure at a fuel rail or fuel manifold mounted to the engine of an automotive vehicle. A support structure of the module usually includes a flange mounted sealably to the fuel tank and a reservoir can defining a reservoir. The fuel pump is usually located in the reservoir and draws fuel therefrom. The reservoir receives fuel from the surrounding, and much larger, fuel supply chamber defined by the fuel tank.

The reservoir provides a reliable source of liquid fuel for the fuel pump even when the larger fuel chamber is relatively low of fuel and/or when the fuel within the supply chamber sloshes about due to movement of the vehicle or any other dynamics occurring relative to the combustion engine. A jet pump assembly is typically used to maintain adequate fuel levels in the reservoir by routing a minority portion of fuel from the electric pump outlet and sending it through a venturi tube which in-turn aspirates a much greater amount of fuel from the fuel tank and into the reservoir. The jet pump assembly functions continuously regardless of reservoir fuel level and regardless of the fuel pressure at the pump outlet or pressure at the fuel rail. Unfortunately, during degraded or harsh conditions such as cold engine starts or substantially low voltage conditions, the electric motor fuel pump may not be capable of operating at full speed. When the electric pump operation is impaired, a potential exists that the engine may be starved of fuel during cold engine starts and/or low voltage conditions.

SUMMARY OF THE INVENTION

A fuel system has a jet pump assembly which fills a fuel reservoir for providing a reliable source of adequate liquid fuel to an electric motor fuel pump located in a fuel tank for a combustion engine. The electric fuel pump preferably delivers fuel to a series of fuel injectors of the engine and at a controlled pressure. The jet pump assembly diverts a small portion of the fuel exiting the electric pump and aspirates a larger quantity of fuel from a fuel chamber defined by the fuel tank and into the reservoir. A biased closed pressure responsive valve prevents fuel flow to the venturi tube when the electric fuel pump is running under impaired conditions, thus delivering all the fuel from the electric pump to the combustion engine typically during engine cold start conditions.

Objects, features and advantages of this invention include a fuel system with a jet pump assembly which will not deprive a starting engine of full fuel output during low voltage or impaired electric motor fuel pump operation. Other advantages include a more economical and robust fuel pump module having an electric motor fuel pump which need not be designed with excess normal capacity to handle low voltage conditions, improved engine cold starts, more reliable engine starts, relatively quiet operation, and a design which is relatively simple, economical to manufacture and assemble, and requires little to no maintenance and in service has a long and useful life.

BRIEF DESCRIPTION OF THE DRAWING

These and other objects, features and advantages of the invention will become apparent from the following detailed description of the preferred embodiment(s) and best mode, appended claims, and accompanying drawings in which:

DETAILED DESCRIPTION OF THE PREFERRED EMBODIMENTS

Figure 1:
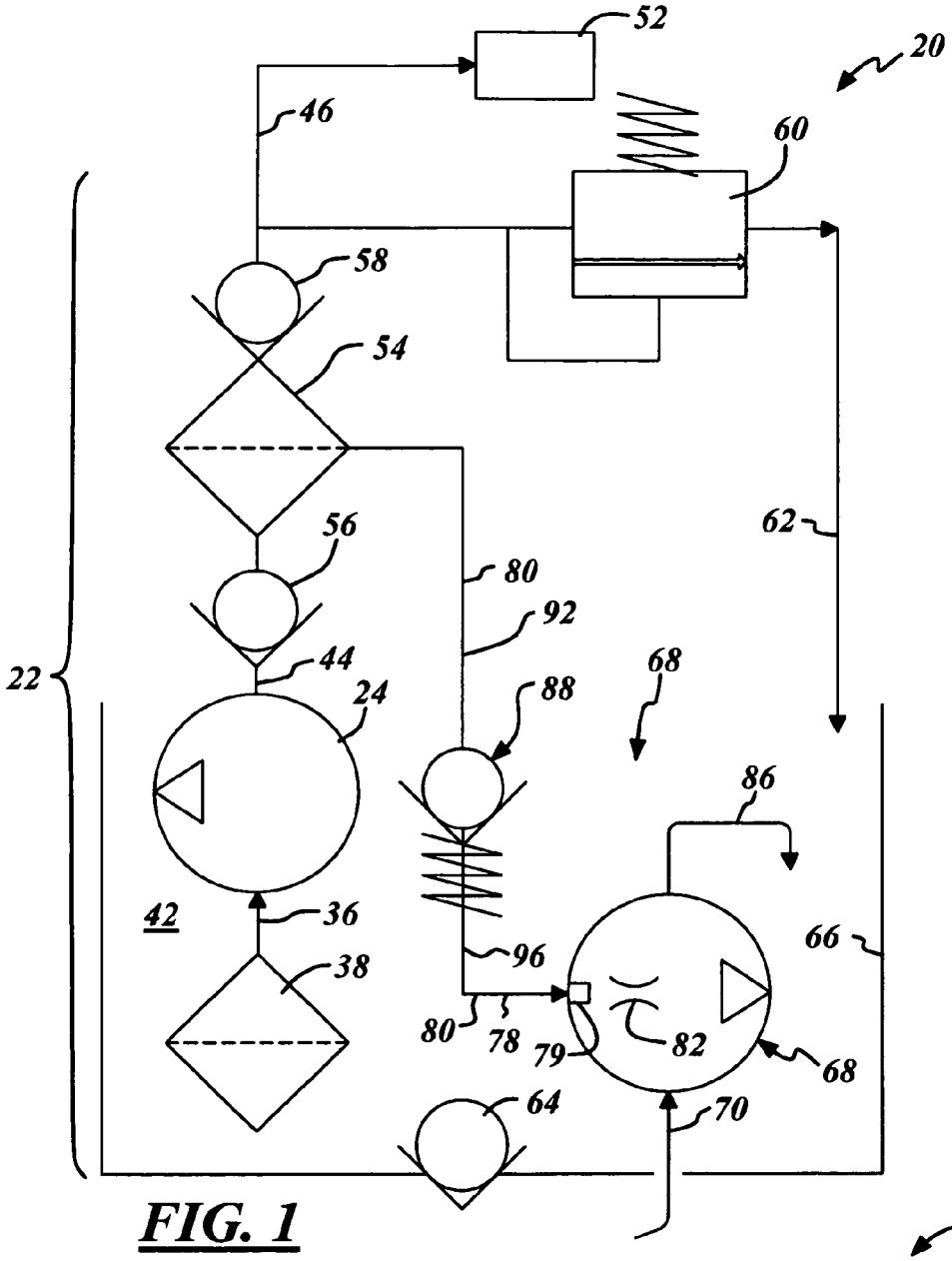
FIG. 1 is a block diagram of a fuel system embodying the present invention.
Figure 2:
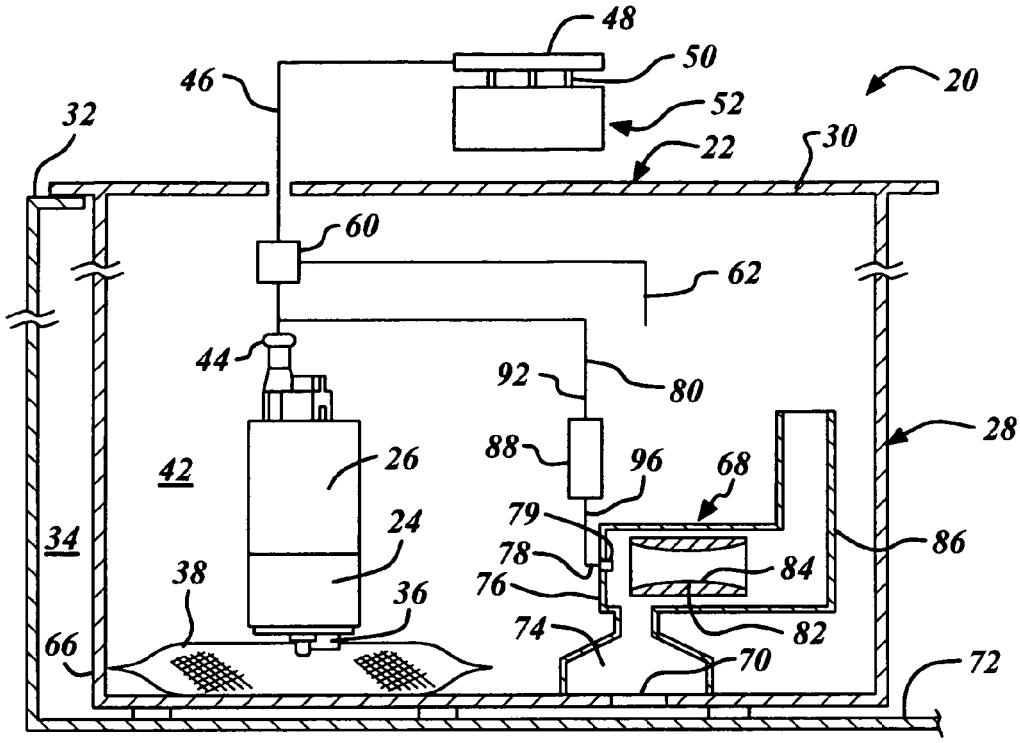
FIG. 2 is a diagrammatic view of the fuel system.
Figure 3:
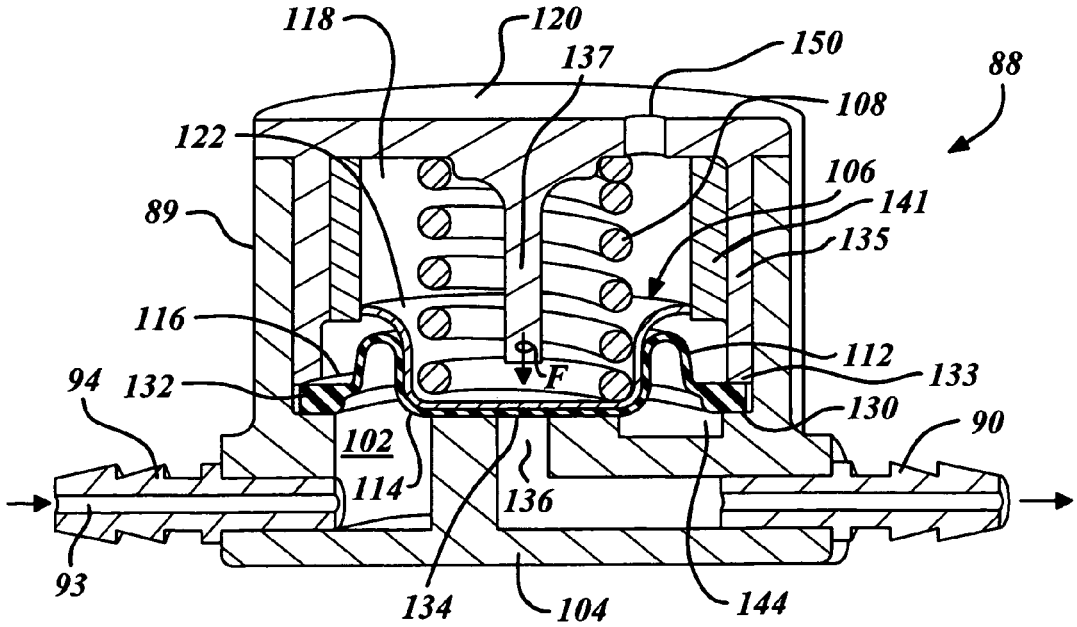
FIG. 3 is a cross section of a pressure valve of a jet pump assembly of the fuel system.
Figure 4:
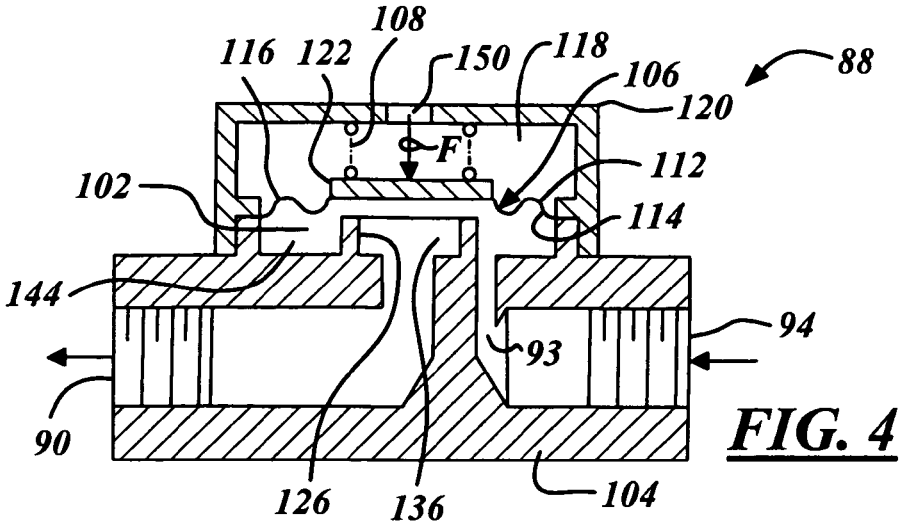
FIG. 4 is a diagrammatic cross section of the pressure valve illustrated in an open position.
Figure 5:
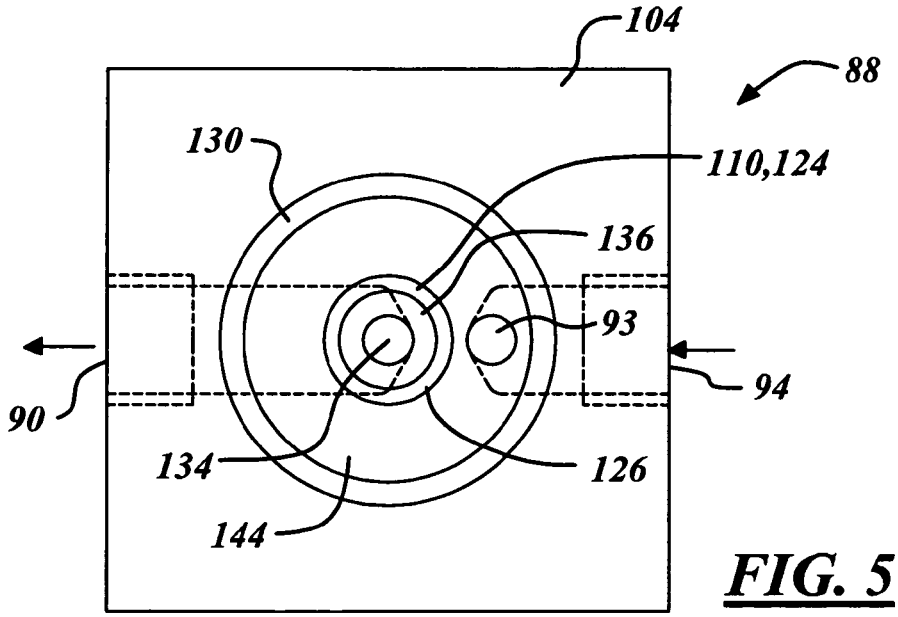
FIG. 5 is a top view of a valve body of the pressure valve with a cap removed to show detail.
Figure 6:
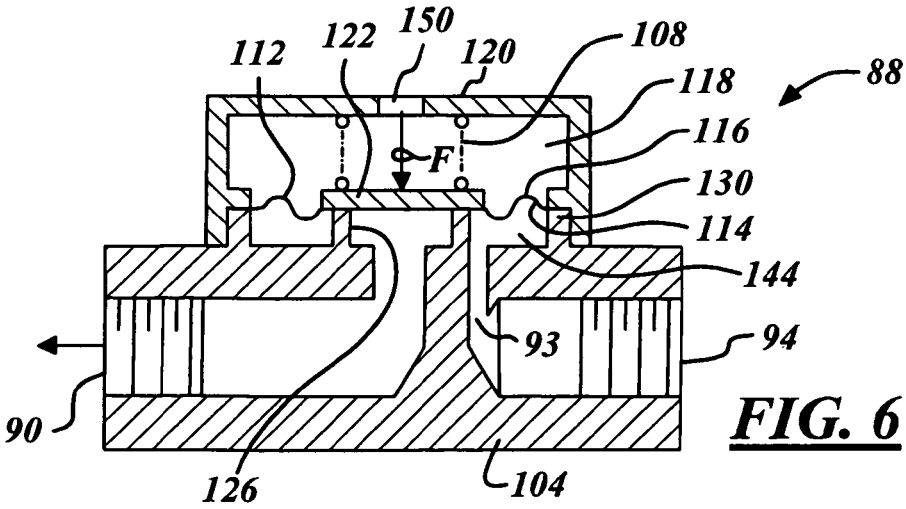
FIG. 6 is a diagrammatic cross section of the pressure valve illustrated in a closed position.

Referring in more detail to the drawings, FIGS. 1 and 2 illustrate a vehicle fuel system 20 with an in-tank fuel pump module 22 having a fuel pump 24 and an electric motor 26 supported preferably by a structure 28 that preferably includes a flange 30 engaged sealably to a fuel tank 32 that defines a fuel storage chamber 34. The fuel pump 24 has an inlet 36 that receives fuel preferably through a filter 38, capable of filtering at preferably about thirty-one microns, from a fuel reservoir or sub-chamber 42 defined by the structure 28 and disposed in the fuel storage chamber 34 of the tank 32. An outlet 44 of the fuel pump 24 delivers liquid fuel through a vehicle fuel conduit 46 to a fuel rail 48 of a combustion engine 52 having at least one fuel injector 50 for controlling fuel flow to respective combustion chambers of the engine 52. Preferably the fuel supply conduit 46 communicates with the pump outlet 44 through an outlet filter 54 disposed between two check valves 56, 58 of the module 22 to prevent backflow (as best shown in FIG. 1). The outlet filter 54 is capable of filtering at about eight microns to generally protect the fuel injectors 50. Downstream of the check valve 58 is a pressure regulator 60 to control fuel pressure at the fuel rail 48 by bypassing a portion of fuel out of the supply conduit 46. Typically, a bypass conduit 62 returns the bypassed fuel to the reservoir 42 or the fuel supply chamber 34.

Pressure control, however, at the fuel rail 48 may be achieved by a variety of ways with or without varying forms of a pressure regulator 60. For instance, the fuel pump 24 and motor 26 can be a variable-speed-type, responsive to fuel demand of the operating engine. Moreover, the fuel system 20 in general may be of a no-return-type as illustrated with the bypass conduit 62 in FIG. 2, or may be of a return-loop-type with excess fuel returned from the engine fuel rail (not shown). Both types with corresponding pressure regulators 60 are described in detail in U.S. Pat. No. 6,343,589, and U.S. CIP patent application, Ser. No. 10/946,953, filed Sep. 22, 2004, and incorporated by reference herein in their entirety.

As best illustrated in FIG. 1, an umbrella or check valve 64 located at the bottom of a reservoir can 66 preferably of the structure 28 primes the reservoir with fuel when initially filling an empty tank 32 with fuel. During filling when the fuel level in the supply chamber 34 is generally higher than the fuel level in the reservoir 42, the check valve 64 opens allowing fuel to enter the reservoir 42. After filling the tank, and when the engine 52 is running and the fuel pump 24 is in full operation, the jet pump assembly 68 functions to maintain needed fuel levels in the reservoir 42, regardless of supply chamber level, for reliable pump operation. The check valve 64 remains closed if fuel level in the supply chamber falls below fuel level in the reservoir and while the jet pump assembly 68 continues to maintain needed fuel level in the reservoir can 66.

The jet pump assembly 68 can be located remotely in the fuel supply chamber 34 away from the fuel pump module 22 but is preferably integrated into the structure 28 of the module and as such receives fuel for aspiration from a first or low pressure fuel inlet port 70 defined by the structure 28 and located in close proximity to a bottom 72 of the tank 32 (as best shown in FIG. 2). The low pressure inlet port 70 communicates directly with a jet cavity 74 defined by a housing 76 of the structure 28 and generally disposed preferably in the reservoir 42. Pressurized fuel is supplied to a second or high pressure inlet 78 to a restricted orifice or nozzle 79 of the jet pump assembly 68 through a supplemental conduit 80 of the fuel pump module 22 that communicates with the pump outlet 44 or supply conduit 46 preferably immediately downstream of the outlet filter 54 and preferably between the check valves 56, 58.

An upper portion of the cavity 74 generally situates a venturi tube 82 of the jet pump assembly 68 preferably press fitted or molded in the housing 76 and constructed to receive the pressurized fuel flowing through the high pressure inlet 78 and restricted orifice 79. The venturi tube 82 has a reduced diameter portion or throat 84, and fuel flow therethrough creates a pressure drop within the jet pump housing 76 to draw or aspirate fuel from the fuel storage chamber 34, through the low pressure inlet or port 70, through the jet cavity 74, and into the reservoir 42. The pressurized fuel received from conduit 80 and flowing through the venturi tube 82 also discharges into the reservoir 42 and may thereafter be drawn into the fuel pump 24. Preferably, a substantially vertical stand-pipe or conduit 86 is located at the outlet of the venturi tube 82 that extends above the desired reservoir fuel level for preventing drainage of the reservoir 42 and cavity 74 back into the fuel supply chamber 34 when the jet pump assembly 68 is inactive. Alternatively, the stand-pipe 86 can be replaced with a check valve (not shown) at the low pressure inlet 70 preventing reservoir and cavity drainage.

In accordance with the present invention, a pressure responsive valve 88 prevents fuel flow through the supplemental conduit 80 to the jet pump 68 during low fuel pressure conditions typically caused by low voltage and/or cold start engine conditions that may temporarily impair fuel pump 24 performance. During such conditions, it is desirable to route all of the fuel exiting the electric pump outlet 44 through the supply conduit 46 to the engine 52 thus assuring that the starting engine is not deprived of adequate fuel. Once the engine 52 starts and system voltage is restored, the fuel pump 24 and motor 26 becomes fully operational and achieves normal operating fuel pressure at the pump outlet 44 causing the pressure valve 88 to open and initiate operation of the jet pump assembly 68 restoring the desired fuel level in the reservoir 42, particularly if the fuel level in the fuel supply chamber 34 is generally lower than the desired fuel level in the reservoir 42, otherwise, the umbrella valve 64 will also function to maintain at least some degree of fuel level in the reservoir 42.

The pressure valve 88 divides the conduit 80 into an upstream pump side 92 and a downstream jet side 96. Preferably, an inlet barb connector 94 projects outward from a body 104 of the valve 88 and press fits into the pump side 92 of the conduit 80, and a barbed outlet connector 90 projecting outward from the body 104 press fits into the jet side 96 of conduit 80 for liquid fuel communication therethrough. The connectors 90, 94 are preferably injection molded plastic and can be press fitted or threaded to the valve body 104 or molded to the body 104 as one unitary piece.

As best shown in FIGS. 3-6, the pressure responsive valve 88 has a valve head assembly 106 preferably having a flexible and convoluted diaphragm 112 located sealably between a vented reference chamber 118 and a valve chamber 144. The reference chamber is defined by a first side 116 of the diaphragm 112 and a cap 120 preferably vented to the interior of the fuel tank 32 through an aperture or vent 150 in the cap 120. With the valve 88 in an open position, the valve chamber 144 is generally defined by an opposite second side 114 of the diaphragm 112 and the body 104. The valve head assembly 106 cooperates with an annular valve seat 110 carried by the body and intermittently exposed to the valve chamber 144 to control the flow of high pressure fuel to the jet pump assembly 68. Pressurized fuel enters an outer annular portion 102 of the valve chamber 144 through an inlet 93 generally at the inlet connector 94. When the valve 88 opens, fuel flows over the seat 110, into a smaller cylindrical portion 136 of the valve chamber 144, and through an outlet passage 136 in the body 104 that has the outlet connector 90 preferably press fitted therein.

The diaphragm 112 has a peripheral edge 132 compressed and sealed between a shoulder 130 of the valve body 104 and the end 133 of an annular side wall 135 of the cap 120. The diaphragm 112 yieldably biases to a normally closed position (FIGS. 3 and 6) of sealing engagement with the seat 110 by a compression spring 108 received between cap 120 and a cup 122 of the valve head assembly 106 bearing on the diaphragm 112. To guide the opening and closing movement of the diaphragm 112, an annular sleeve 141 slidably receives the cup 122 with a slight clearance. The annular, downward projecting, side wall 135 of the cap 120 carries and preferably has a slight interference fit with the sleeve 141. A stop 137 limits the extent that the diaphragm 112 can move away from the seat 110 and preferably is a center pin 137 formed integrally with the cap 120. A distal end of the center pin 137 contacts the cup 106 to prevent overtravel of the diaphragm 112 which might otherwise damage it. Alternatively, the stop 137 can be integrated into the design of the spring 108. Thus, when the spring 137 is fully compressed upon itself, flexing of the diaphragm 112 is limited.

The diaphragm 112 is preferably made of a fabric reinforced, fuel resistant, rubber, polymer, or synthetic rubber. The pressure valve 88 has good repeatability and opens at a consistent setpoint pressure because the upstream annular portion 102 of the valve chamber 144 is substantially larger than the downstream cylindrical portion 136 of the valve chamber 144 and thus exposes a greater surface area of side 114 of the diaphragm 112 to the inlet fuel pressure.

In operation, the pressure valve 88 will open from the normally biased closed position when the total hydraulic force exerted on the fuel-side 114 of the diaphragm 112 exceeds the total closure biasing force F exerted on the reference side 116. The total closure biasing force is substantially the spring force (produced by spring 108) plus that force generated by the pressure within the vented reference chamber 118. When the fuel supply chamber 34 is at or near atmospheric pressure or if the reference chamber 118 or tank is vented to atmosphere, the closure biasing force F is substantially the spring force alone. Regardless, because the reference chamber 118 vents preferably in the tank 32, operation of the valve 88 correlates with varying dynamics of the fuel tank pressure.

For the sake of example, and utilizing a General Motors Corporation GMT360370 fuel delivery module designed to operate fully at about 13.8 volts and preferably within a range of about twelve to fourteen volts, D.C., normal fuel system operating pressure is about four-hundred killo-pascals (kPa) and total fuel flow exiting the fuel pump is about one-hundred and fifty liters-per-hour (lph). At this operating pressure, the pressure drop across the open diaphragm-type pressure valve 88 is minimal, or about or less than two kPa. About twenty-one lph of the total fuel flow exiting the fuel pump flows through the supplemental conduit 80, through the open pressure valve 88 and through the jet pump assembly 68 to produce an aspirated fuel flow rate, into the reservoir of typically about one-hundred and fifty to one-hundred and eighty lph and which is generally greater than the peak fuel demand of the engine 52 of about one-hundred and fifty lph.

Test data utilizing the GMT360370 fuel delivery module has demonstrated that with an impaired system voltage of about 7.1 volts, D.C., the pump 24 will deliver a total fuel flow of thirty-three lph at a reduced pressure of about three-hundred kPa. Because the pressure valve 88 is preferably designed to open at about three-hundred and thirty-two kPa, it remains closed during the low system voltage condition. All thirty-three lph thus flows to the engine 52 for reliable engine starting. Once the engine is started and before the reservoir 42 is depleted of fuel, the system voltage and system fuel pressure are restored and the three-hundred and thirty-two kPa setpoint of the pressure valve 88 is exceeded opening the valve.

Figure 10:
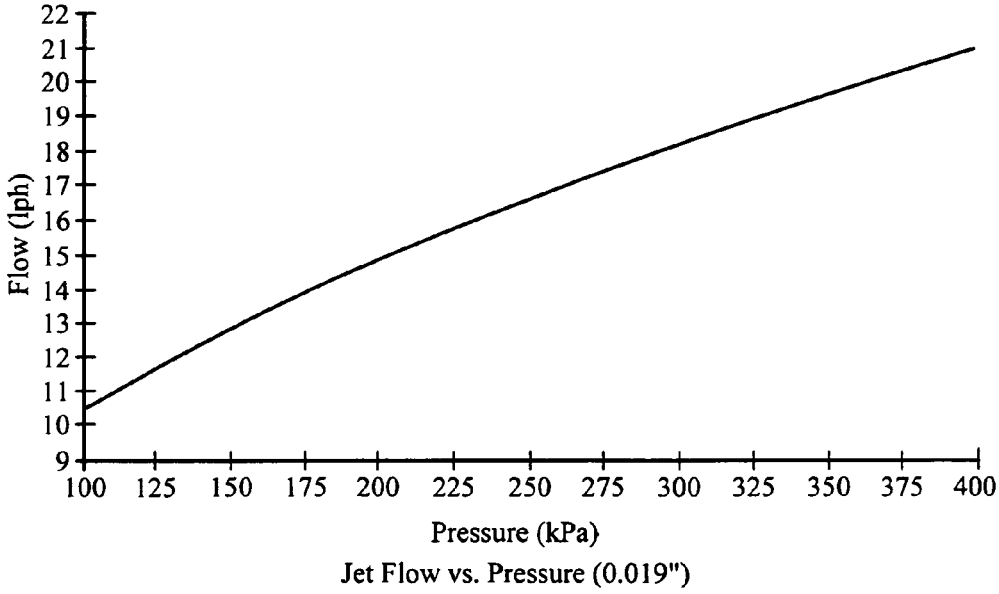
FIG. 10 is a graph of the inlet fuel flow versus inlet fuel pressure of the jet pump assembly in operation.

Referring to FIG. 10, because fuel aspiration or flow through the jet pump assembly 68 is generally a mathematical function of the square root of the incoming fuel pressure, a small pressure drop across the pressure valve 88 is advantageous and enables a relatively small throat diameter of the venturi tube 82 of about 0.019 inches. For instance, at normal fuel system pressure of about four-hundred kPa, fuel flow through the nozzle 79 is about twenty lph (about fifteen percent of total fuel exiting the fuel pump) producing a total aspirated fuel flow of about one-hundred and fifty to one-hundred and eighty lph. If the system fuel pressure is impaired to about one-hundred kPa, fuel flow through the venturi nozzle 79 would still be relatively high and about ten lph (possibly about forty to fifty percent of total fuel exiting the fuel pump). This deprivation of fuel flow to the engine during impaired fuel pump 24 operation and engine starting accentuates the benefits of the pressure valve 88.

Figure 7:
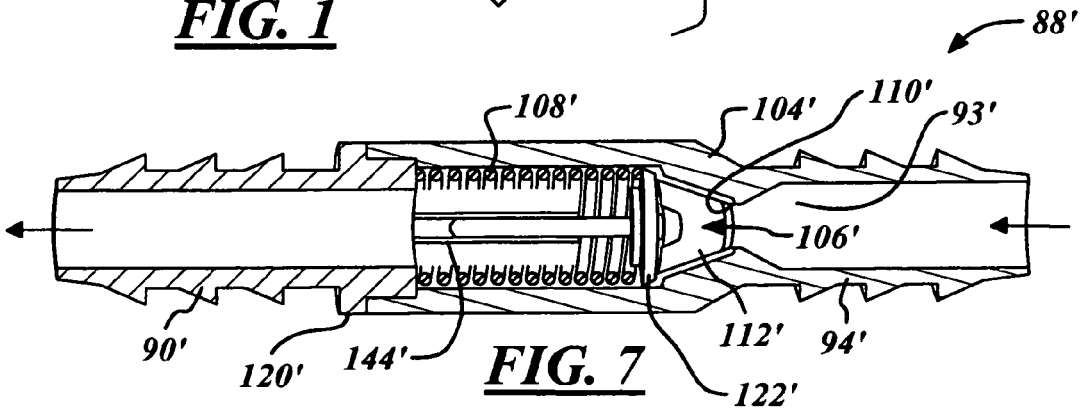
FIG. 7 is a cross section of a modified pressure valve.
Figure 8:
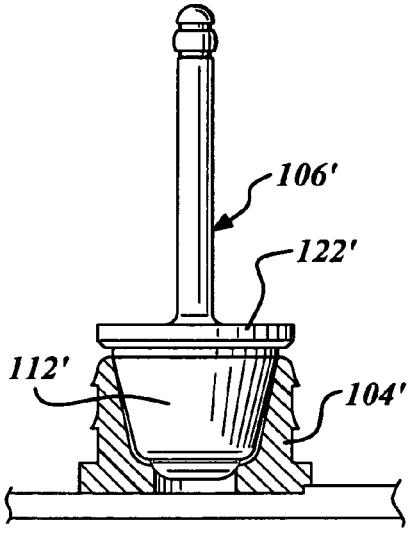
FIG. 8 is an enlarged view of a valve head of the pressure valve of FIG. 7.
Figure 9:
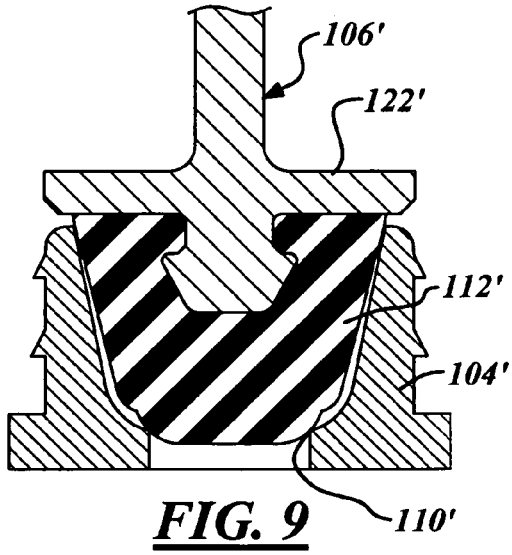
FIG. 9 is a cross section of the valve head of FIG. 7.

As best illustrated in FIGS. 7-9, a modification of the fuel pump module 22 includes replacement of the diaphragm-type pressure valve 88 with an in-line poppet-type pressure valve 88' having an enlarged tapered head assembly 106' preferably with a resilient outer encasement 112', and which is biased closed by a compression spring 108'. The compression spring 108' is preferably compressed between an end cap 120' formed unitary to an outlet connector 90' and an annular face 116' of a cup 122' opened or facing downstream with respect to the supplemental fuel flow. The spring 108' is disposed in a jet-side flow chamber 144' defined by the cap 120' and body 104' and integrated into the supplemental conduit and disposed downstream of a generally annular valve seat 110' carried by the body 104'.

The poppet-type pressure valve 88' is generally less expensive to manufacture than the diaphragm-type pressure valve 88', however, it has a greater inherent pressure drop and is generally noisier than the diaphragm-type pressure valve 88. When utilizing the GMT360370 fuel pump module, the pressure drop across the poppet-type pressure valve 88' is about three-hundred kPa with a fuel system pressure of about four-hundred kPa, which is substantially higher than the two kPa of the diaphragm-type pressure valve 88. The subsequent loss in fuel supply pressure at the jet pump assembly 68 can be countered by increasing the venturi throat diameter from the 0.019 inches previously described, to 0.025 inches for about one-hundred kPa operation and to produce a total aspiration flow rate of about one-hundred and fifty to one-hundred and eighty lph. Preferably, the body and housing of the pressure valve is made of injection molded plastic having a relatively high carbon content for electrical conduction and to reduce or eliminate electrostatic charge build-up.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A liquid fuel system for a fuel injected combustion engine comprising:

a fuel reservoir configured to be disposed in a fuel tank;

a fuel pump having an inlet communicating with the reservoir and at least one fuel outlet configured for supplying fuel to the combustion engine;

an electric motor connected to the fuel pump for operating the fuel pump;

a jet pump assembly for transferring fuel from the fuel tank into the reservoir;

an in-line pressure poppet valve assembly interposed between the fuel outlet and the jet pump assembly, yieldably biased toward a closed position and when closed preventing supplemental fuel flow to the jet pump assembly during impaired fuel pump operation, and the in-line poppet valve assembly having a housing having a fuel inlet, an annular seat downstream of the fuel inlet, an annular flow chamber downstream of the seat and tapering outwardly downstream of the seat; and a valve having an enlarged head engageable with the annular seat to close the valve assembly, received in the annular flow chamber, tapered outwardly downstream of the annular seat, and when moved to an open position is disengaged from the seat so that fuel flows around the head, through the flow chamber and into the jet pump assembly for transferring fuel from the fuel tank into the reservoir.

2. The liquid fuel system set forth in claim 1 comprising:

the enlarged head of the pressure valve assembly having an outer encasement of a resilient material engageable with the annular seat; and a spring between the housing and the enlarged valve head in the flow chamber for yieldably biasing the pressure valve assembly closed.

3. A liquid fuel system for a fuel injected combustion engine comprising:

a fuel reservoir configured to be disposed in a fuel tank;

a fuel pump having an inlet disposed in the reservoir and at least one fuel outlet;

a supply conduit communicating between the outlet and the combustion engine;

a jet pump assembly for transferring fuel from the fuel tank into the reservoir;

a supplemental conduit communicating between the fuel outlet and the jet pump assembly;

a pressure valve interposed in the supplemental conduit and yieldably biased toward a closed position and when closed preventing supplemental fuel flow to the jet pump assembly during impaired fuel pump operation;

the supplemental conduit being at least in part a tube interposed by the pressure valve;

a barbed inlet nozzle of the pressure valve fitted sealably into a pump side of the tube; and a barbed outlet nozzle of the pressure valve fitted sealably into a jet side of the tube.

4. The liquid fuel system set forth in claim 3 wherein the pressure valve comprises:

a cap defining in part a reference chamber;

a valve body defining in part a valve chamber;

a flexible diaphragm having a peripheral edge engaged sealably between the cap and the valve body; and a spring disposed in the reference chamber and compressed axially between the cap and the diaphragm.

5. The liquid fuel system set forth in claim 1 wherein the pressure valve assembly opens against the biasing force of a spring and the jet pump flows fuel into the reservoir from the fuel tank when the combustion engine is operating at normal voltage conditions, and wherein the pressure valve is closed when the combustion engine is operating at substantially below normal voltage conditions and the jet pump assembly is not operating to flow fuel from the fuel tank and into the reservoir.

6. The liquid fuel system set forth in claim 5 wherein the reservoir is of sufficient volume to hold enough fuel to warm up a cold-started operating engine.

7. The liquid fuel system set forth in claim 1 further comprising a check valve located adjacent a bottom of the reservoir for flowing fuel from the fuel supply chamber into the reservoir.

8. The liquid fuel system set forth in claim 7 wherein the check valve is an umbrella valve.

9. The liquid fuel system set forth in claim 1 further comprising:

a housing of the jet pump assembly;

a jet cavity of the jet pump assembly defined by the housing and a bottom of the reservoir;

a tube of the jet pump assembly supported by the housing and communicating between the supplemental conduit and the jet cavity at an inlet and the reservoir at an outlet; and a low pressure port in the bottom of the reservoir and communicating with the jet cavity.

10. The liquid fuel system set forth in claim 9 further comprising a stand-pipe communicating with the outlet of the tube.

11. The liquid fuel system set forth in claim 9 further comprising a check valve located at the low pressure port for preventing fuel flow from the jet cavity to a fuel storage chamber defined by the fuel tank.

12. The liquid fuel system set forth in claim 1 further comprising a structure for supporting the fuel pump and electric motor, and the structure having a flange for engagement sealably to the fuel tank.

13. The liquid fuel system set forth in claim 12 further comprising:

a housing of the jet pump assembly defining a cavity communicating with the fuel tank through a low pressure inlet port adjacent a bottom of the reservoir; and a tube of the jet pump assembly disposed in the cavity, supported by the housing and communicating with the supplemental conduit and cavity at a high pressure inlet.

* * * * *